US005632339A

United States Patent [19]

Fenske et al.

[11] Patent Number: 5,632,339

[45] Date of Patent: May 27, 1997

[54] FIRE PROTECTION SPRINKLER HEAD WITH SPACED ZONES FOR MOUNTING A PROTECTIVE GUARD AND FOR CONNECTING THE SPRINKLER HEAD TO A WATER SUPPLY LINE

[75] Inventors: John W. Fenske, Wauwatosa; John R. Simons, deceased, late of Milwaukee, both of Wis., by Barbara J. Simons, personal representative

[73] Assignee: Star Sprinkler Corporation, Milwaukee, Wis.

[21] Appl. No.: 386,819

[22] Filed: Feb. 10, 1995

[51] Int. Cl.[6] ..... A62C 37/11

[52] U.S. Cl. ..... 169/37; 169/51; 239/288.5

[58] Field of Search ..... 169/51, 37, 38, 169/39, 40, 41, 90; 239/209, 288, 288.3, 288.5

[56] References Cited

U.S. PATENT DOCUMENTS

| | | | |
|---|---|---|---|
| 793,357 | 6/1905 | Diederici | 169/38 |
| 1,044,459 | 11/1912 | Kersteter | 169/39 |
| 1,392,593 | 10/1921 | Newton | 169/38 |
| 1,469,336 | 10/1923 | Rowley | 169/51 |
| 1,771,826 | 7/1930 | Taylor | 169/38 |
| 2,534,065 | 12/1950 | Rowley | 169/39 |
| 3,314,482 | 4/1967 | Young | 169/38 |
| 3,698,483 | 10/1972 | Martin et al. | 169/37 |
| 3,797,746 | 3/1974 | Gray et al. | 239/288.5 |
| 3,815,821 | 6/1974 | Metcalfe | 169/37 |
| 3,818,994 | 6/1974 | Livingston | 169/37 |
| 3,880,239 | 4/1975 | Vorkapich | 169/37 |
| 4,366,866 | 1/1983 | Sweeney | 169/37 |
| 4,987,957 | 1/1991 | Galaszewski | 169/37 |

*Primary Examiner*—Andrew C. Pike
*Attorney, Agent, or Firm*—Andrus, Sceales, Starke & Sawall

[57] ABSTRACT

A sprinkler head comprises a tubular body having a first threaded end to be connected to a water line and having a second end that defines an outlet enclosed by a cap. A thermally responsive element, such as a glass bulb or heat fusible element, is engaged with the cap to maintain the cap in a closed position. The body is provided with a pair of generally parallel circumferential grooves. The bottom of one of the grooves adjacent the threaded end has a polygonal cross section to receive a wrench to enable the sprinkler head to be threadedly attached to a water line, while the other of the grooves receives the base portion of a wire-form protective guard that encloses the thermally responsive element.

13 Claims, 1 Drawing Sheet

FIRE PROTECTION SPRINKLER HEAD WITH SPACED ZONES FOR MOUNTING A PROTECTIVE GUARD AND FOR CONNECTING THE SPRINKLER HEAD TO A WATER SUPPLY LINE

BACKGROUND OF THE INVENTION

Sprinkler heads that depend from low ceilings or those mounted in storage racks in industrial or commercial establishments frequently include a wire-form protective guard, which prevents accidental damage to the thermally responsive element, such as a glass bulb or fusible element.

In a typical installation, each sprinkler head is connected to the water system by threading the sprinkler head to the water line through use of a special wrench or tool that engages a polygonal-shaped ridge or groove on the body of the sprinkler head. After installation of the sprinkler head, the wire guard is then installed on the sprinkler head. The wire guard is typically connected to the sprinkler head by engaging the base of the guard with the wrench groove, and the guard is then locked to the body by fasteners such as screws, or other fastening means.

The installation of the protective guards is very time consuming and labor intensive. Such labor intensity and time consumption may be amplified by the common practice of installing all of the sprinkler heads first and then returning later to each sprinkler location to install the wire form guard in a second operation. Each wire guard is composed of two or more components, and the workman is normally working in an awkward overhead position, or in the case of storage racks, in relatively inaccessible locations. As a storage rack in an industrial or commercial establishment may contain thousands of sprinkler heads, the installation of the protective guards constitutes a time consuming process which comprises a substantial portion of the overall cost of the sprinkler system.

SUMMARY OF THE INVENTION

The invention is directed to a sprinkler head having a pre-assembled wire guard which will not interfere with the normal installation of the sprinkler head with the water line.

The sprinkler head includes a tubular body, one end of which is threaded to a water line, while the opposite end defines an outlet that is normally enclosed by a cap or closure.

In the preferred form of the sprinkler head, the body also includes a pair of arms which are joined together at a junction, and a thermally responsive member, such as a glass bulb or fusible element, is connected between the junction and the cap, thus retaining the cap in a closed position. When the thermally responsive member is exposed to an elevated temperature, it will release, enabling the pressure of the water in the water line to dislodge the cap and the water will then be discharged into the building or other establishment in a conventional manner.

In accordance with the invention, the body of the sprinkler head is provided with a pair of circumferentially extending zones which preferably take the form of external grooves. The bottom of the groove which is located adjacent the threaded end of the body is provided with a polygonal configuration, preferably hexagonal, and is adapted to receive a wrench or tool. Engagement of the tool with the groove enables the sprinkler head to be rotated to thread the sprinkler head to the water line.

The base of a wire-form protective guard is secured within the second of the two grooves. The guard itself can be of conventional construction and includes a mechanism for locking the base portion within the second groove.

With the invention, the guard is preassembled with the sprinkler head at the factory, and as the wire guard does not restrict access to the wrench groove, the guard can be retained in place while the sprinkler head is attached to the water line. This results in a substantial savings in time and labor, due to the fact that it is not necessary to install the protective guard after installation of the sprinkler head to the water line. This provides a substantial overall cost saving in the sprinkler system.

Moreover, as the guard is attached to the sprinkler head at the factory, it will protect the thermally responsive element during shipment and handling of the sprinkler head.

Other objects and advantages will appear during the course of the following description.

BRIEF DESCRIPTION OF THE DRAWINGS

The drawings illustrate the best mode presently contemplated of carrying out the invention.

In the drawings.

DETAILED DESCRIPTION OF THE ILLUSTRATED EMBODIMENT

Figure 1:
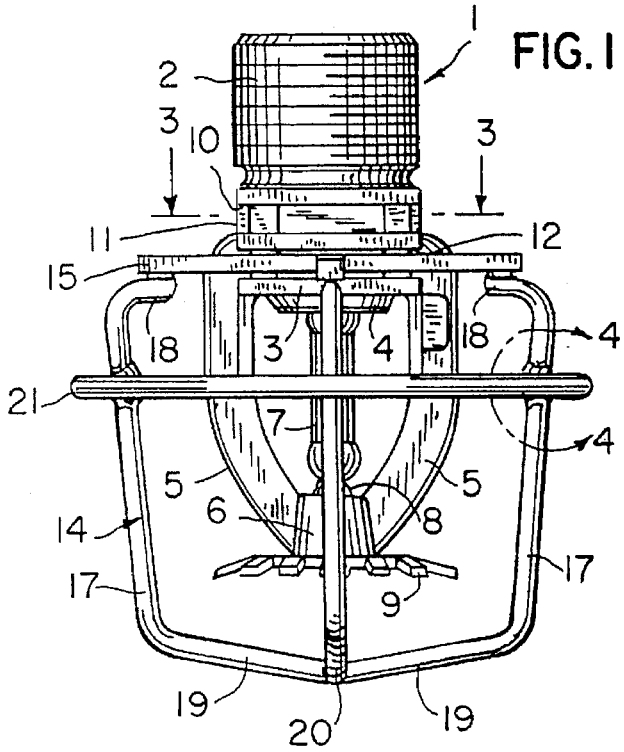
FIG. 1 is a side elevation of the sprinkler head of the invention.
Figure 4:
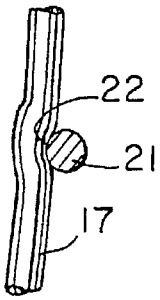
FIG. 4 is an enlarged fragmentary side elevation illustrating the locking mechanism for the wire guard, with reference to detail 4 of FIG. 1.

FIG. 1 illustrates a sprinkler head including a body or frame 1 having an external thread 2 that is adapted to be connected to a water line. The opposite end of the tubular body 1 defines an outlet 3 which is normally sealed by a cap or closure 4.

Body 1 also includes a pair of depending arms 5 and the outer ends of the arms are joined at a junction 6. As shown in FIG. 1, a thermally responsive member 7 interconnects the cap 4 and an adjusting screw 8 which is threaded within an opening in the junction 6.

The thermally responsive member can take the form of a conventional glass bulb or alternately a fusible element. When the thermally responsive member is exposed to an elevated temperature, it will release, enabling the water pressure within the water line to dislodge cap 4. The water will then flow outwardly through outlet 3 and be deflected radially outward in a spray pattern by a deflector 9, which is carried by the junction 6.

A wrench boss or groove 10 is formed in body 1 outward of the thread 2, and the bottom 11 of groove 10 has a non-circular, polygonal shape, preferably hexagonal. In addition to groove 10, a second circumferential groove 12 is formed outwardly of groove 10 and the bottom of groove 12 also can have a non-circular or polygonal configuration, such as hexagonal.

Groove 10 serves to receive a conventional wrench or tool through which the sprinkler head can be threaded onto the water line, while groove 12 receives a water permeable wire form protective guard 14.

Figure 2:
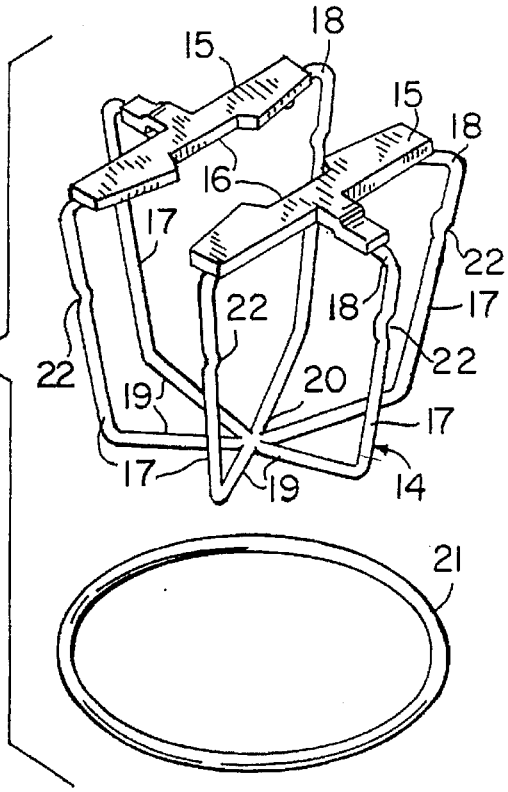
FIG. 2 is an exploded view of the wire-form guard, with the sprinkler head removed.
Figure 3:
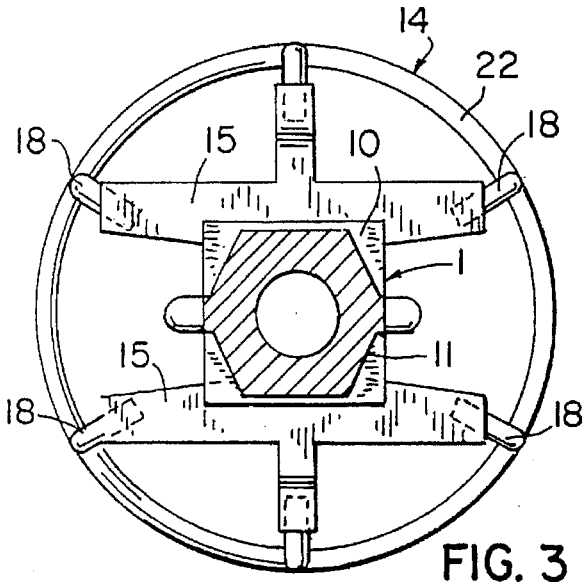
FIG. 3 is a section taken along line 3—3 of FIG. 1.

As shown in FIG. 2, guard 14 includes a pair of generally parallel base members 15, each of which is formed with a recess 16 which is adapted to engage opposite sides of the bottom of groove 12.

A series of wire arms 17 are each provided with a bent foot 18, and each foot is attached to the respective base members 15. The outer ends of arms 17 are bent radially inward as indicated by 19, and are joined together at a junction 20.

To lock the guard to the body 1, a locking ring 21 is employed. By sliding the ring 21 inwardly over the arms 17, the arms will be deflected inwardly to bring the base members 15 into tight engagement with groove 12. Locking ring 21 is secured in position by engagement with detents or notches 22 formed in the arms 17.

When locked in position, guard 14 surrounds the thermally responsive member 7 and serves to protect that member during shipment, storage, and usage.

With the use of the double parallel grooves, the guard 14 can be installed at the factory by engaging the base members 15 with the groove 12. The second wrench groove 10 is accessible when the guard 14 is in place so that the sprinkler head can be threaded to the water line without removal of the guard.

The invention thus eliminates the conventional task of having to install the guard 14 after the sprinkler head is attached to the water line.

As previously noted, the task of connecting the protective guard, as required in the past, was time consuming, because the guard is normally composed of multiple components and the operator is required to work in an awkward overhead position, or in a relatively inaccessible location when dealing with storage racks, in order to install the guard.

As the guard, as associated with the sprinkler head of the invention, is installed at the factory, it also serves to protect the thermally responsive member from damage during shipment and handling.

We claim:

1. A fire protection sprinkler head comprising a body having a first end to be connected to a water supply line and having a second end defining an outlet, a closure to enclose said outlet, a thermally responsive member secured by said body and engaged with said closure to maintain said closure in a closed position, said thermally responsive member being releasable when exposed to a preselected elevated temperature, a first zone on said body, a second zone on said body spaced longitudinally from said first zone and disposed between said first zone and the first end of the body, said second zone having a configuration constructed and arranged to receive a tool to connect said body to said water supply line, and said first zone being configured to engage a base portion of a water permeable protective guard for enclosing said thermally responsive member.

2. The sprinkler head of claim 1, wherein said first zone has a noncircular configuration.

3. The sprinkler head of claim 1, wherein the thermally responsive member comprises a glass bulb.

4. The sprinkler head of claim 1, wherein the thermally responsive member comprises a fusible element.

5. The sprinkler head of claim 1, wherein said first end of said body is provided with an external thread to be connected to said water line.

6. A fire protection sprinkler head comprising a body having a first end to be connected to a water supply line and having a second end defining an outlet, a closure to enclose the outlet, a thermally responsive member secured by said body and engaged with said closure to maintain said closure in a closed position, said thermally responsive member being releasable when exposed to a preselected elevated temperature, a first substantially peripherally extending zone on said body, a substantially peripherally extending second zone on said body and disposed longitudinally between said first zone and said first end of said body, said second zone having a configuration constructed and arranged to receive a tool to connect the body to the water supply line, and wherein said first zone is configured to engage a base portion of a water permeable protective guard for enclosing said thermally responsive member, wherein said first and second peripherally extending zones comprise grooves in said body.

7. A fire protection sprinkler head comprising a body having a first end and a second end, an external thread on said first end of the body and disposed to be connected to a water supply line, said second end defining an outlet, a cap enclosing said outlet, a thermally responsive member secured by said body and engaged with said cap to maintain said cap in a closed position, said thermally responsive member being releasable when exposed to a preselected elevated temperature, said body comprising a first external, peripheral groove, said body also comprising a second external, peripheral groove located longitudinally between said first groove and said thread, said second groove including an inner surface having a polygonal configuration to receive a tool to enable said body to be attached to said water supply line, and wherein said first groove is configured to engage a base portion of a water permeable protective guard for enclosing said thermally responsive member.

8. The sprinkler head of claim 7, and further including locking means for locking said base portion to said first groove.

9. The sprinkler head of claim 7, wherein said first groove includes a bottom surface having a polygonal configuration.

10. In a fire protection sprinkler head including a body having a first end connectable to a water supply line and a second end defining an outlet, a closure to enclose the outlet, a thermally responsive member secured by the body and engaged with the closure to maintain the closure in a closed position, said thermally responsive member being releasable when exposed to a preselected elevated temperature, and a water permeable protective guard, the improvement comprising:

first engagement structure on said body, wherein said protective guard includes a base portion engageable with said first engagement structure for mounting said protective guard to said body; and second engagement structure on said body spaced longitudinally from said first engagement structure and disposed between said first engagement structure and the first end of said body, wherein said second engagement structure is configured to receive a tool to connect said body to the water supply line;

wherein said second engagement structure enables use of the tool to connect said sprinkler head to the water supply line after said protective guard base portion is engaged with said first engagement structure to mount said protective guard to said body.

11. A fire protection sprinkler head comprising:

a body having a first end connectable to a water supply line and a second end defining an outlet, said body including longitudinally spaced first and second engagement structures;

a closure for enclosing said outlet;

a thermally responsive member secured by said body and engaged with said closure to maintain said closure in a closed position, said thermally responsive member being releasable when exposed to a preselected elevated temperature;

a deflector spaced from said outlet;

a frame extending from said body and interconnected with said deflector and said thermally responsive member; and a protective water permeable guard having a base portion engageable with said first engagement structure for mounting said protective guard to said body, and a plurality of arm members extending from said base portion and located outwardly of said frame and said deflector;

wherein said second engagement structure is disposed between said first engagement structure and said first end of said body and has a configuration constructed and arranged to receive a tool to connect said sprinkler head to the water supply line after said protective guard base portion is engaged with said first engagement structure to mount said protective guard to said body.

12. The sprinkler head of claim 11, wherein said protective guard base portion includes a pair of opposed base members for engaging opposite portions of said first engagement structure.

13. The sprinkler head of claim 12, wherein said opposed base members are interconnected with each other via said protective guard arm members.

* * * * *